US006596990B2

(12) United States Patent
Kasten et al.

(10) Patent No.: US 6,596,990 B2
(45) Date of Patent: Jul. 22, 2003

(54) INTERNAL DETECTION OF IONS IN QUADRUPOLE ION TRAPS

(75) Inventors: Arne Kasten, Karlsruhe (DE); Jochen Franzen, Bremen (DE)

(73) Assignee: Bruker Daltonik GmbH, Bremen (DE)

( * ) Notice: Subject to any disclaimer, the term of this patent is extended or adjusted under 35 U.S.C. 154(b) by 201 days.

(21) Appl. No.: 09/877,418

(22) Filed: Jun. 8, 2001

(65) Prior Publication Data

US 2002/0008198 A1 Jan. 24, 2002

(30) Foreign Application Priority Data

Jun. 10, 2000 (DE) ..... 100 28 914

(51) Int. Cl.[7] ..... H01J 49/42

(52) U.S. Cl. ..... 250/292; 250/282; 250/283; 250/397

(58) Field of Search ..... 250/282, 283, 250/290, 291, 292, 397

(56) References Cited

U.S. PATENT DOCUMENTS

| | | | | |
|---|---|---|---|---|
| 2,939,952 A | | 6/1960 | Paul et al. | |
| 3,527,939 A | | 9/1970 | Dawson et al. | |
| 4,540,884 A | | 9/1985 | Stafford et al. | |
| RE34,000 E | | 7/1992 | Syka et al. | |
| 5,468,957 A | | 11/1995 | Franzen | |
| 5,625,186 A | | 4/1997 | Frankevich et al. | |
| 6,087,658 A | * | 7/2000 | Kawato | 250/292 |
| 6,157,030 A | * | 12/2000 | Sakairi et al. | 250/292 |
| 2002/0185596 A1 | * | 12/2002 | Amy et al. | 250/292 |

FOREIGN PATENT DOCUMENTS

| | | |
|---|---|---|
| DE | 40 17 264 A1 | 12/1991 |
| EP | 0 383 961 A1 | 8/1990 |

OTHER PUBLICATIONS

Knight, Randall D., "The General Form Of The Quadrupole Ion Trap Potential", International Journal of Mass Spectrometry and Ion Physics, 51 (1983) 127–131, Elsevier Science Publishers B.V., Amsterdam, Netherlands.

* cited by examiner

*Primary Examiner*—Jack Berman

(57) ABSTRACT

The invention relates to methods and devices for the detection of ions in an RF quadrupole ion trap. The invention consists of integrating a detector, such as a secondary-electron multiplier, into the end cap electrode with form and potential fit, thereby avoiding the ion outlet holes in the end caps, which might otherwise lead to field disturbances. Ions that leave the field by mass-selective and mass-sequential ejection using one of the known scan methods are measured when they impact on the end cap electrode. Both positive and negative ions can be measured. In the case of positive ions, it is also possible to measure the ions that impact on the side opposite the detector by means of their secondary electrons.

15 Claims, 1 Drawing Sheet

INTERNAL DETECTION OF IONS IN QUADRUPOLE ION TRAPS

BACKGROUND OF THE INVENTION

Ion trap mass spectrometers of the type considered here contain a quadrupole ion trap operated with RF voltage. This ion trap was invented by Paul and Steinwedel, and is described in U.S. Pat. No. 2,939,952. It consists of two opposed end cap electrodes and a ring electrode situated between them in the center plane; in its theoretical ideal form, it has hyperboloids of revolution for the end cap and ring electrodes, the hyperbolas having asymptotes which intersect each other with an angle 2=arc tang ($1/\sqrt{2}$).

Due to the patents U.S. Pat. No. 3,527,939 (Dawson and Whetten: "Mass-selective storage"), U.S. Pat. No. 4,548,884 (Stafford, Kelley, Stephens: "Mass-selective instability of ions"), US Re 34,000 (Syka, Louris, Kelley, Stafford, Reynolds: "Mass-selective resonance ejection"), EP 0 383 961 (Franzen, Gabling, Heinen, Weiss: "Mass-selective ejection by non-linear resonance") and GB 2 278 232 or DE 43 16 738 (Franzen: "Mass-selective ejection by superimposition of additional dipole and quadrupole alternating fields"), methods have become known for operating ion traps as mass spectrometers which work with various kinds of mechanism for ejection of the ions one after the other ("mass-sequential"), separated according to their mass-to-charge ratio ("mass-selective") and which measure the ions by means of a detector fitted outside the ion trap, generally with a secondary-electron multiplier. In these methods, the end cap electrode facing the detector is perforated so that the ions can be ejected.

Mass spectrometry cannot determine the mass of ions—but only their mass-to-charge ratio, which is termed "specific mass" in several places in the Paul and Steinwedel patent. The ions predominantly carry only a small number of elementary charges (mostly only one). In the following, when reference is made to the mass of ions and to "heavy ions" as opposed to "light ions" or "mass-selective ejection", this must always be understood to mean this "charge-related mass" or "specific mass".

The resonance methods are based on the fact that the ions can be excited in the ion trap between the end cap electrodes so that they oscillate ("fundamental oscillations" or "secular oscillations"). The frequency of the oscillations is strictly dependent on their charge-related mass, and also the type and strength of field in the ion trap, that is the RF voltage, the RF frequency or possibly superimposed DC voltage. For a field of constant frequency and without superimposed DC voltage, only the RF voltage and the specific mass determine the frequency of oscillation of an ion.

Due to the patents EP 0 321 819 (Franzen, Gabling, Heinen, Weiss: "Distorted quadrupole field with Q<3.99") and EP 0 459 602 (Franzen: "Clean superimposition of hexapole and octopole field"), improved forms of ion trap electrodes have become known, which produce an improvement in the ejection behavior of the ions during the scanning due to non-linear resonances by superimposition of higher-order multipole fields.

The perforations in the apex of the dome-shaped end cap electrode for the outlet of the ions represent a disturbance of the electrical field in the ion trap. This field is required to be essentially a quadrupole field, but on which higher-order multipole fields can be superimposed in a targeted manner so as to improve the oscillatory behavior of the ions in the ion trap and the enlargement of their oscillation amplitude for ejection to permit spectrum measurement. The disturbances of the field in the ion trap caused by the holes in the end cap mean that not all of the ions of a particular mass emerge at the same time: the ion signal of the ions of a particular mass is spread temporally, and the mass resolution of the mass spectrometer is reduced.

The outlet holes for the ions are usually formed as a seven-hole arrangement, and also as a single central hole in the apex of the dome-shaped end cap electrode. To minimize the disturbances of the electrical RF field in the ion trap, the holes only have a very small diameter. However, this means that not all the ions can emerge and reach the detector: more than half the ions impact on the margins of the electrodes around the holes and are discharged there. As a result, the sensitivity of the ion trap mass spectrometer is reduced.

It is known that the filling of the ion trap with ions must be restricted, as otherwise the resolving power, and also the mass calibration, that is the relationship between ejection time and exact ion mass, will be disturbed by space-charge effects. For this reason there is always an upper limit for filling the ion trap with ions; the sensitivity of the ion trap mass spectrometer therefore depends on the degree to which the limited number of ions in the trap is exploited for measurement of the spectrum.

Mass resolving power and sensitivity are, however, the essential selling criteria for ion trap mass spectrometers. A good mass resolving power permits faster scanning and thereby increases the sensitivity by increasing the number of spectra per unit of time. The sensitivity of the mass spectrometer is in demand, especially in the modem biosciences, where exceptionally small quantities of substance have to be measured. As a rule of thumb, it can be said that a possible doubling of sensitivity justifies the development of a new spectrometer.

SUMMARY OF THE INVENTION

The above-mentioned patent U.S. Pat. No. 2,939,952 of Paul and Steinwedel already proposed measuring the ion stream of the ions impacting on the end cap by measuring the effective load of the RF generator. It is now the basic idea of the invention to no longer allow the ions to emerge from the trap through holes in an end cap electrode for the purpose of detection, but to measure them when the ions impinge on the closed end cap electrode, as in Paul's patent, but not as the effective load of the RF generator. The new idea is to integrate an ion detector into the electrode form. This ion detector exactly follows the ideal form of the end cap electrode, carries the potential of the end cap electrode on its surface and thereby causes no disturbance to the field in the ion trap. The detector can be a simple Faraday detector, which feeds the ion current to a measuring amplifier; and in particular, the ion detector can be a secondary electron multiplier.

Modern secondary electron multipliers (SEM) can be manufactured in flat shapes, for example in the shape of plates as so-called multi-channel plate multipliers. Another type of manufacture uses the pores of a frit consisting of ceramic or glass particles (e.g. microbeads) as secondary electron amplifying channels. In particular, these frit-shaped secondary electron multipliers can also be manufactured with curved surfaces. Their pores are very small; superficially, they look very smooth. With this frit-shaped type of secondary electron multiplier, the dome shapes of the end cap electrode are relatively easy to reproduce.

When the ions impact on the porous surface of this secondary electrode multiplier, secondary electrons are formed in the familiar way and are drawn into the pores by a strong voltage drop in the frit. There they are accelerated by inner fields, form further secondary electrons when they impact on the pore surfaces, and thus form an electron avalanche which emerges on the other side of the frit and can be measured as a real electron current by a collecting electrode. In this way, both positive and negative ions can be measured.

In the case of positive ions, another advantage of the arrangement can be utilized. Those positive ions which impact during enlargement of their oscillation amplitude for ejection onto the end cap electrode opposite the detector end cap electrode also give rise to secondary electrons there. These pass through the ion trap intermediate area in only a few nanoseconds and impact on the secondary electron multiplier. They therefore amplify the ion current measurement by also utilizing those ions which are ejected on the "wrong side" of the ion trap. For this purpose, it is useful to provide the opposite end cap electrode with a surface which has a good yield of secondary electrons.

The method of operating the ion trap according to the invention with a smoothly fitting secondary electron multiplier in the end cap electrode has the additional advantage that it automatically compensates for the lower sensitivity of the secondary electron multiplier for heavier ions. The yield of secondary electrons during the first impact of the ions on the surface decreases greatly as the mass of the ions increases—at the same ion energy level. Heavy ions, which are generally of particular interest, are thus detected far less sensitively than light ions. However, when operating the detector according to the invention, the impact energy of the ions is automatically increased as their mass increases, since all modern ejection methods operate with a mass-proportional increase of the RF voltage. This voltage determines the impact energy of the ions.

DETAILED DESCRIPTION

Figure 1:
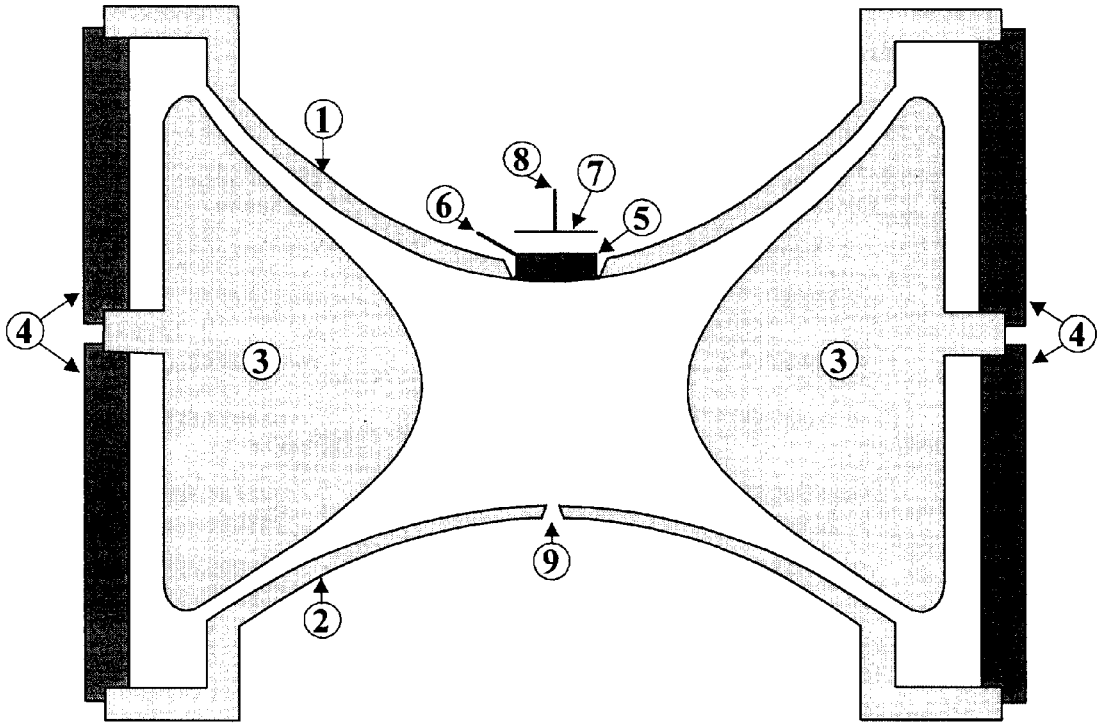
FIG. 1 shows the cross section through an ion trap for a mass spectrometer according to the invention.

A particularly favorable embodiment of an ion trap for a mass spectrometer according to this invention is shown in FIG. 1. FIG. 1 shows the cross section through an ion trap for a mass spectrometer having two end cap electrodes (1, 2) and a ring electrode (3), which is held fixed to the end cap electrodes by spacers. The detector (5), a frit-type secondary electron multiplier, is fitted into the end cap electrode (1), smoothly fitted in form and potential. Its electron outlet side is supplied with voltage via the supply lead (6). The collecting electrode (7) with supply lead (8) takes up the electron current from the secondary electron multiplier and passes it on to a measuring amplifier. The ion trap can be filled either with externally generated ions through the injection hole (9); or a gaseous sample can be introduced into the trap and ionized by an electron or laser beam through this hole (9). The electrodes of the ion trap are not pure hyperboloids in the ion trap shown here. Due to changes of shape, according to DE 40 17 264, a hexapole and an octopole field is generated in addition. The ring electrode has an internal diameter corresponding approximately to the distance between the end cap domes so as to attain the same field strength in the space between the end cap electrodes with less RF voltage.

As mentioned above, the frit-type secondary electron multiplier is fitted as an ion detector into one of the end cap electrodes with a form and potential fit. The detector surface is metallized and the metal layer is short-circuited with the rest of the end cap electrode. In this way, the field in the ion trap remains undisturbed. The back of the frit-type secondary electron multiplier is also metallized, and the metal layer carries a voltage of several kilovolts, which generates an inner field inside the secondary electron multiplier and thus allows the electron avalanche to occur in the interior.

In this embodiment, the ion trap is operated by an RF voltage with a frequency of one megahertz. This RF voltage is also called storage voltage. It is applied to the ring electrode while the end cap electrodes are essentially at mass potential. This RF voltage can be varied in the range from 0 to approx. 30 kilovolts (peak to peak). The spectrum is scanned while the RF voltage is changing.

In contrast to the shape of an ion trap shown in the patent of Paul and Steinwedel, in which the inner ring diameter is larger than the distance between the end cap electrode domes by a factor square root of two, in the present case a diameter of the ring electrode is selected which corresponds approximately to the distance between the two end cap domes. According to Knight (Int. J. Mass Spectrom. Ion Processes 1991, 106, 31) this can be done without changing the shape of the enclosed quadrupole field by the surface of the ring electrode following a different potential surface of the desired field. The effect of this is firstly that the field strength in front of the end caps increases in relation to the field strength in front of the ring electrode, so that—with the same RF voltage—the energy of the ions impacting on the end cap electrodes is increased. The second effect is that this ion trap requires a smaller voltage for its operation than the ion trap of Paul. A smaller voltage would, however, be unfavorable for the energy of the ions impacting on the detector. However, by increasing the frequency of the RF voltage applied, it is possible to increase the voltage back to any desired level, since the movement behavior of the ions only depends on the relationship of the square of the angular frequency$^2$ to the RF voltage V. This produces a second advantage in that the speed of scanning is also accelerated again and can be kept proportional to the angular frequency.

Furthermore, the electrodes of this ion trap are shaped so that both a hexapole field and an octopole field are superimposed, according to GB 2 278 232, so as to be able to accelerate ejection of the ions from the field by utilizing the non-linear resonances which occur as a result. As a particularly favorable embodiment of an associated measuring method, a procedure using ejection by a non-linear hexapole resonance is described here.

The ion trap as shown in FIG. 1 is set by a relatively small RF voltage so that ions in the interesting charge-related mass range can be stored. If, for example, ions with charge-related masses in the range of m/e=300 up to 3,000 atomic mass units per elementary charge are to be stored and measured, an RF voltage of approx. 3,000 volts (peak to peak) must be applied. No DC voltage is superimposed on the RF voltage in this embodiment. The voltage on the secondary electron multiplier is switched off so as not to damage the secondary electron multiplier by overloading with non-capturable ions during the filling process. The ion trap is now filled with ions of the substance being analyzed. For this purpose, the vaporized sample can be put into the ion trap and ionized there in the normal way, for example with an electron beam or a laser. It is also possible, however, for the sample ions to be ionized outside the ion trap in an independent ion source and then introduced into the ion trap as an ion beam in the way shown, and captured and stored there.

In the ion trap there is a damping gas in a pressure range from approx. 0.01 to 1.0 Pascal. This causes the ions to collect in the center of the ion trap while giving off their oscillation energy. For this purpose, a damping time of a few milliseconds is required. During this time, the voltage of the secondary electron multiplier is also switched on so as to produce a state of equilibrium of the voltage distribution in the interior of the secondary electron multiplier for the subsequent scanning. A few milliseconds are also required for this.

For scanning, the oscillation-exciting dipole field is first switched on by applying a small excitation voltage (with a phase-adjusted frequency of exactly a third of the storage high frequency) to the end cap electrode opposite the detector. The end cap electrode with the detector is kept at ground potential. Applying the dipolar excitation voltage to only one of the end cap electrodes causes division of the field generated thereby into a very weak quadrupole field, which plays no part here, and a weak dipole field, which can excite the ions if their fundamental oscillations are in resonance with the dipole alternating field between the end caps.

The spectrum is now scanned by increasing the RF storage voltage linearly with time. In our case, this means from 3 kilovolts to 30 kilovolts, peak to peak. During this process one ion type after another resonates with the applied dipole alternating voltage separately (that is "mass-selectively") and successively (that is "mass-sequentially") as the charge-related masses increase. The resonating ions begin to oscillate and increase their oscillation amplitude more and more. The increase in oscillation amplitude in a dipole field is linear with time, that is it grows constantly with time. Somewhat outside the center of the ion trap, the ions are now further excited by the non-linear hexapole resonance at this frequency. This causes a hyperbolic increase in oscillation amplitude with time, so that (outside the center of the ion trap, in which it has no effect) it is much stronger than the dipolar excitation. As a result, the amplitude of the ion oscillation grows at an extremely fast rate; within a few oscillations the ions reach the end cap electrodes, where they are measured by the detector according to the invention. The current of ions with masses increasing on a charge-related basis is measured over time to acquire the mass spectrum. The charge-related masses are proportional to the RF voltage at which they are impinging on the detector.

Due to the undisturbed field in the interior of the ion trap, especially around the location of ion ejection, a high mass resolving power is maintained. At a scanning speed of only 36 microseconds per charge-related mass unit covered (that corresponds to only 12 fundamental oscillations of the ejected ions), the charge-related mass range from 300 to 3,000 atomic mass units per elementary charge can be scanned in less than 100 milliseconds. At the same time, it is to be expected that for even four-fold charged ions full resolution of the mass signals will be achieved. The resolution is thus 0.25 atomic mass units per elementary charge for this fast scan of the spectrum. Due to the space charge limitation, on the one hand, and the improved ion yield at the detector, on the other hand, more than double the quantity of ions per spectrum can be measured compared to arrangements with perforated cap electrodes, according to the prior art. The latter arrangements, in principle, also have a slower scanning speed due to the disturbances caused by the holes.

The asymmetrical form of the electrodes for generating the superimposed hexapole field (see FIG. 1) means that the end cap electrode with the detector is preferred for the impact of the ions. Nevertheless, it is not possible to avoid the ions also impacting on the other end cap electrode. These ions discharge there and are lost for detection purposes in all the methods according to the prior art. But if the surface is prepared, according to the invention, for a high yield of secondary electrons, a large number of secondary ions are formed. When positive ions impact, a field prevails which immediately accelerates these secondary electrons onto the detector. There they will in turn cause secondary electrons in the pores of the secondary electron multiplier, and these secondary electrons are measured as an amplified avalanche at the collecting electrode, thus permitting measurement of at least a part of the otherwise lost ions.

If, however, these ions cause disturbance, for example for quantitative analysis, the surface opposite the detector can also be designed so that no secondary electrons are formed. The energy of the impacting ions is difficult to determine exactly. However, it can be estimated that the energy for the above method is approximately the same as if the ions had passed through half the peak voltage of the applied RF voltage (for methods which operate more slowly, the energy is lower). In our case, therefore, specifically light ions from the beginning of the spectrum, that is ions with approx. 300 atomic mass units per elementary charge, impact on the secondary electron multiplier with approx. 1.5 kilo-electronvolts per elementary charge. That is enough for good signal generation by light ions. However, the RF voltage is increased beyond the spectrum, as a result of which the impact energy of the ions which are heavier relative to charge increases up to 15 kilovolts per elementary charge at the end of the mass spectrum, that is for ions with 3,000 atomic mass units per elementary charge. This effect is particularly favorable. According to the prior art, light ions were always overemphasized, whereas heavier ions were measured far too weakly because all the ions were accelerated onto the detector with the same energy per charge, but the heavier ions displayed a far smaller yield.

From this detailed description of an embodiment of the measuring method according to the invention, the specialist can easily exploit the detection according to the invention for other methods of scanning according to the prior art, for example for the method of "mass-selective instability" according to U.S. Pat. No. 4,548,884, where the ions, with a change of field, are driven towards the end caps by their movement differential equations becoming instable.

Thus, for example, the described method with utilization of the non-linear hexapole resonance can be further enhanced by additional superimposition of a quadrupole alternating field with a frequency which is ⅔ of the RF frequency, according to GB 2 278 232.

What is claimed is:

1. A quadrupole ion trap mass spectrometer comprising:

a plurality of dome-shaped end cap electrodes;

a ring electrode; and an ion detector embedded within a cross-sectional area of one of the end cap electrodes.

2. A mass spectrometer according to claim 1, wherein the detector is a secondary electron multiplier.

3. A mass spectrometer according to claim 2, wherein the secondary electron multiplier has a frit-type basic structure.

4. A mass spectrometer according to claim 2, wherein the secondary electron multiplier is supplied with voltage by a fast-switching voltage generator.

5. A mass spectrometer according to claim 1, wherein the ion detector is arranged such that its shape and electrical potential cause no significant disturbance in the desired ion trap field.

6. A mass spectrometer according to claim 1, wherein one of the end cap electrodes is geometrically opposite the detector and has a surface with a high secondary electron yield.

7. A quadrupole ion trap mass spectrometer comprising:

a plurality of dome-shaped end cap electrodes;

a ring electrode; and an a secondary electron multiplier ion detector embedded within a cross-sectional area of one of the end cap electrodes, the ion detector being arranged such that its shape and electrical potential cause no significant disturbance in a desired ion trap field.

8. A mass spectrometer according to claim 7, wherein the secondary electron multiplier has a frit-type basic structure.

9. A mass spectrometer according to claim 7, wherein the secondary electron multiplier is supplied with voltage by a fast-switching voltage generator.

10. A mass spectrometer according to claim 7, wherein one of the end cap electrodes is geometrically opposite the detector and has a surface with a high secondary electron yield.

11. A method for measuring a mass spectrum with a mass spectrometer, the method comprising:

locating ions of interest in an ion trap mass spectrometer having a plurality of dome-shaped end cap electrodes and a ring electrode;

sequentially driving ions from the ion trap in a mass-sequential manner by increasing an RF voltage at the ring electrode; and measuring the ejected ions with an ion detector embedded within a cross-sectional area of one of the end cap electrodes.

12. A method according to claim 11 wherein the ions are driven out by their paths becoming unstable outside the stability range of their movement differential equations.

13. A method according to claim 11 further comprising providing a dipolar alternating field by providing an additional excitation voltage between the end cap electrodes so that the ions are driven out of the trap field by resonance with the dipole alternating field.

14. A method according to claim 13 wherein oscillation amplitudes of the ions are initially increased by the additional excitation voltage between the end cap electrodes ant thereafter experience an additional increase of their oscillation amplitudes by a non-linear resonance.

15. A method according to claim 11 wherein a voltage at the detector is switched off during filling of the ion trap with ions and is only switched on shortly before scanning of the spectra.

* * * * *